US007645418B2

(12) United States Patent
Munding et al.

(10) Patent No.: US 7,645,418 B2
(45) Date of Patent: Jan. 12, 2010

(54) GAS WASHING DEVICE

(75) Inventors: Stefan Munding, Weitmarer Strasse 34, D-44795 Bochum (DE); Germann Munding, Bad Friedrichshall (DE)

(73) Assignee: Stefan Munding, Bochum (DE)

( * ) Notice: Subject to any disclaimer, the term of this patent is extended or adjusted under 35 U.S.C. 154(b) by 384 days.

(21) Appl. No.: 11/579,706

(22) PCT Filed: May 3, 2005

(86) PCT No.: PCT/EP2005/004765

§ 371 (c)(1),
(2), (4) Date: Nov. 29, 2006

(87) PCT Pub. No.: WO2005/107979

PCT Pub. Date: Nov. 17, 2005

(65) Prior Publication Data

US 2008/0122145 A1 May 29, 2008

(30) Foreign Application Priority Data

May 5, 2004 (DE) ..... 10 2004 022 129

(51) Int. Cl.
*C21C 7/72* (2006.01)
*C21C 5/48* (2006.01)

(52) U.S. Cl. ..... 266/223; 266/216; 266/217; 266/220; 266/233; 222/603; 137/14; 137/15.24; 137/82; 137/156

(58) Field of Classification Search ..... 222/603; 266/216–224, 233; 137/14, 15.24, 82, 156
See application file for complete search history.

(56) References Cited

U.S. PATENT DOCUMENTS 4,370,969 A * 2/1983 Zarrelli et al. ..... 123/525
6,669,896 B1 * 12/2003 Sahlin et al. ..... 266/220

FOREIGN PATENT DOCUMENTS

| | | |
|---|---|---|
| DE | 34 41 223 | 5/1986 |
| DE | 196 10 578 | 4/1997 |
| WO | WO 01/08834 | 2/2001 |
| WO | WO 01/83831 | 11/2001 |
| WO | WO 01/83832 | 11/2001 |

OTHER PUBLICATIONS

International Search Report.

* cited by examiner

*Primary Examiner*—Roy King
*Assistant Examiner*—Lois Zheng
(74) *Attorney, Agent, or Firm*—Collard & Roe, P.C.

(57) ABSTRACT

A gas purge device for a metallurgical melting vessel includes a conically shaped ceramic body (2) in contact at its top side with heat contained in the melting vessel. The ceramic body has a static external element and an internal element axially movable therein. A pneumatic drive axially moves the internal element to and fro relative to the external element between a closed position and an open position. The spring force of a spring retains the internal element in the closed position. The device furthermore includes a gas-tight enclosed volume arranged at the bottom side of the ceramic body the volume being connected to a gas supply duct for introduction of purge gas. A deformable membrane is connected to the internal element with the pressure difference between the purge gas pressure prevailing in the gas-tight enclosed volume and the ambient pressure acting upon the membrane.

13 Claims, 3 Drawing Sheets

GAS WASHING DEVICE

CROSS REFERENCE TO RELATED APPLICATIONS

Applicants claim priority under 35 U.S.C. §119 of German Application No. 10 2004 022 129.4 filed May. 5, 2004. Applicants also claim priority under 35 U.S.C. §365 of PCT/EP2005/004765 filed May. 3, 2005. The international application under PCT article 21(2) was not published in English.

The invention relates to a gas purge device for a metallurgical melting vessel, including a conically shaped ceramic body getting at its top side in contact with a heat contained in the melting vessel, the ceramic body having a static external element and an internal element axially movable therein, further including a pneumatic drive by way of which the internal element can be axially moved to and fro relatively to the external element of the ceramic body between a closed position and an open position, with a spring being provided, by the spring force of which the internal element is retained in the closed position, and furthermore including a gas-tight enclosed volume arranged at the bottom side of the ceramic body, the volume being connected to a gas supply duct for introduction of purge gas.

Gas purge devices of this kind are commonly utilized for introducing purge gas into a heat contained in a metallurgical melting vessel, for example a steel casting ladle or in a converter. In general, the purge gas is an inert gas blown into the vessel at a high pressure, e.g. 6-10 bars. Thereby it is above all intended to achieve intimate mixing of the heat contained in the melting vessel.

Gas purge devices which are also called "purge plugs" are commonly used on steel works worldwide. These are conical, truncated porous ceramic bodies that are permeable to the purge gas to be blown in and impermeable to the heat. These purge plugs are usually surrounded either entirely or partly by a metal casing. The ceramic body is comprised of a high-refractory aluminum oxide based material. The major drawback of conventional purge plugs of this kind above all lies in that the pores of the ceramic body get clogged relatively quickly in their areas near the surface because an infiltration of liquid metal occurs there. Those areas infiltrated require regular cutting-off to maintain adequate permeability to gas. It inevitably involves high wear which in turn entails substantial cost. For after a certain period of time, these porous purge plugs have been cut-off to such an extent that they require complete replacement.

A gas purge device is disclosed and described in German patent DE 196 10 578 C1 wherein those drawbacks resulting from the wear problems described hereinabove are largely remedied. The prior art gas purge device known from the afore-mentioned printed publication comprises a conically shaped ceramic body which is not porous as with usual purge plugs to allow for introducing the purge gas into the heat. Instead the ceramic body with the prior art gas purge device is comprised of a static external element and an internal element which can be axially moved therein. Owing to the axial movement of the internal element in relation to the external element, a annular gap between the internal element and the external element allowing the purge gas to reach into the heat is opened or closed as required.

A major drawback with the prior art gas purge device lies in that manufacturing the ceramic body is extremely costly. With the prior art device, the external element of the ceramic body comprises a conical depression for the movable internal element, with said depression ending-up in a cavity within the ceramic body. It involves substantial technical difficulties in providing a suitable casting mould for the ceramic body of the prior art gas purge device, and more particularly in removing this casting mould after the casting process, because projections and undercuttings are formed by the afore-mentioned cavity. Besides, the prior art device requires a special gas supply duct conducted through the ceramic material of the static external element so as to enable the introduction of the purge gas into the cavity for blowing into the heat.

With the prior art gas purge device, the axial movement of the internal element in relation to the external element is effected by means of a pneumatic drive. By means of the pressure of the introduced purge gas with the prior art device, the internal element is lifted against the hydrostatic pressure of the heat from its seat in the external element so that the annular gap between the internal element and the external element is opened. Therefore, since the pneumatic drive with the prior art device must work against the hydrostatic pressure of the heat, it is disadvantageously required to supply the purge gas at a correspondingly high pressure.

Now, therefore, proceeding from this basis, it is the object of the present invention to provide a gas purge device wherein the high wear occurring with conventional purge plugs is avoided on the one hand and which can be safely and reliably operated at moderate purge gas pressures on the other hand. At the same time the device should be manufacturable at low cost.

Proceeding from a gas purge device of the kind initially described, this object is achieved in that the pneumatic drive has a deformable membrane connected to the internal element, with the pressure difference existing between the purge gas pressure prevailing in the gas-tight casing and the ambient pressure acting upon said membrane.

The inventive gas purge device entirely does without a cavity arranged in the interior of the ceramic body and responsible for the costly manufacturability of the ceramic body with the afore-mentioned prior art gas purge device. At the same time the inventive gas purge device fulfils a valve function so that the high wear usually associated with conventional purge plugs cannot occur.

An essential point in the inventive gas purge device is the special configuration of the pneumatic drive to move the internal element of the ceramic body between the closed position and the open position. The invention proposes to provide a deformable membrane which the pressure difference existing between the purge gas pressure and the ambient pressure acts upon. The surface area of the deformable membrane is sufficient to exert an adequate force at moderate purge gas pressure to move the internal element. It is possible without any problem to generate a force by means of the deformable membrane that is sufficient to move the internal element versus the hydrostatic pressure of the heat and/or versus the spring force of the spring which is provided to safely retain the internal element in the closed position.

Known from the printed publications WO 01/08834 A1 and WO 01/83832 A1 are gas purge devices not belonging to this species wherein the ceramic body is surrounded by a metal jacket at its side and bottom. With prior art gas purge devices, an internal element which can be axially moved in the ceramic body is connected to the bottom of the metal jacket. Purge gas can be introduced through an appropriate opening into the intermediate space between the bottom of the metal jacket and the ceramic body. Owing to the pressure of the purge gas, the bottom of the metal jacket bulges downward, thereby entraining the internal element of the ceramic body and thus creating an annular gap in the ceramic body through which purge gas is introduced into the heat. A drawback of the prior art gas purge devices known from the afore-mentioned printed publications lies in that the internal element of the ceramic body is retained in the closed position solely by the elastic properties of the bottom plate of the metal jacket, if no purge gas is introduced. In practice it has become evident that on account of the high temperatures in the surroundings of the heat, the bottom plate quickly loses its elastic properties so that the gas purge device fails to close reliably. The heat then leaks through the gas purge device in an uncontrollable manner that might have disastrous consequences in a steel works. These drawbacks of the prior art gas purge device are effectively avoided by the present invention, because according to the present invention the internal element of the ceramic body is brought back into the closed position by way of a spring. The deformable membrane implemented according to the present invention does not have to exert those substantial forces that are required to keep the internal element in closed position. With the inventive gas purge device, the spring can be properly designed in terms of its material, dimension, positioning so that the high thermal load does not adversely affect the function. An uncontrollable leakage of the steel smelt through the gas purge device is thus effectively avoided by the present invention.

The static external element of the ceramic body of the inventive gas purge device may advantageously comprise an axial cone-shaped bore extending continuously from the top side to the bottom side of the ceramic body and accommodating the movable internal element. A ceramic body of this kind can be manufactured particularly easily and at low cost. In accordance with an embodiment of this invention, the bore may be tapered from the bottom side towards the top side of the ceramic body which comes in contact with the heat contained in the melting vessel. According to another embodiment, the bore is tapered vice versa from the top side of the ceramic body towards the bottom side. By way of the latter embodiment, it is achieved that due to the hydrostatic pressure of the heat impacting upon the top side the internal element is pressed against the external element which in a certain way serves as a valve seat. On account of the hydrostatic pressure of the heat, the internal element is thus retained in closed position, wherein the continuous conical annular gap between the internal element and the external element is closed. In this position, neither gas is blown into the heat nor is any leaked metal enabled to leak through the gas purge device from the melting vessel. To blow purge gas into the heat, the internal element is moved upward in the direction of the gas flow so that the conical annular gap between the internal element and the external element opens and thus enables the high-pressure gas to penetrate unrestrictedly into the liquid metal. However, if the axial cone-shaped bore is tapered from the bottom side towards the top side, the internal element is reliably retained in closed position by the spring force of the spring when the purge gas supply is interrupted. With this embodiment, to introduce purge gas, the ceramic internal element is moved downward against the purge gas flow.

With the inventive gas purge device, a gas-tight enclosed volume is arranged at the bottom side of the ceramic body and connected to a gas supply duct for introducing the purge gas. Prevailing in the interior of this volume is the pressure of the introduced purge gas which is blown into the heat from the volume through the continuous conical annular gap between the internal element and the external element of the ceramic body in opened position of the device.

Expediently the gas-tight enclosed volume with the inventive gas purge device is formed by a casing at the bottom side of the ceramic body, with the side wall of the gas-tight casing having a conical shape in such a way that the conical shaping of the ceramic body advances in the area of the casing. Accordingly, the side wall may be configured as a conical plate sheathing that laterally surrounds the entire gas purge device comprised of the ceramic body and the gas-tight casing mounted to its bottom side. Owing to the uniform conical shaping of the inventive gas purge device resulting thereof as a whole, it can be unproblematically installed instead of conventional purge plugs in existing conical openings which usual metallurgical melting vessels have in the bottom or wall area. Another benefit is that the side wall of the gas-tight casing can find support at the inner wall of the metallurgical melting vessel opening provided for the gas purge device, thus ensuring that the gas-tight casing withstands the possibly high pressure of introduced purge gas.

With the inventive gas purge device, the gas-tight casing is reasonably closed at its bottom side by a bottom plate sealed versus the side wall, with the bottom plate finding support through struts at a fixing plate mounted to the bottom side of the ceramic body. The fixing plate can be fastened through appropriate anchoring means to the ceramic body. If the gas purge device is built into a metallurgical melting vessel, it is solely accessible via the bottom plate. Therefore, the gas supply duct for introducing the purge gas into the gas-tight casing should expediently be connected at the bottom plate.

As an alternative, the deformable membrane of the pneumatic drive can provide a gas-tight sealing for the interior of the casing downwards versus the environment. This variant is particularly easy to realize at low cost. When introducing purge gas into the gas-tight sealed volume, the deformable membrane which so to say forms the bottom of the casing bulges downward. Thereby, the internal element of the ceramic body which is connected to the membrane is moved in relation to the external element so that the annular gap for blowing-in of purge gas opens.

The valve function of the inventive gas purge device, as outlined hereinabove, is actuated by the pneumatic drive. Accordingly, it is the task of the pneumatic drive to ensure that the pressure of the purge gas, in particular, which also is the working medium for the pneumatic drive, is sufficient to move the movable internal element against the force exerted by the hydrostatic pressure of the heat and/or the spring from the closed position into the open position. Since actuating the valve function of the inventive gas purge device requires a linear movement of the internal element in relation to the external element, it is expedient to provide a connecting rod for the pneumatic drive to link the deformable membrane with the internal element. In accordance with a particularly advantageous embodiment, this connecting rod is configured as a pipe that simultaneously serves as gas supply pipe for introducing the purge gas into the gas-tight volume.

The pneumatic drive of the inventive gas purge device may reasonably comprise a membrane cylinder, with a venting pipe extending from the gas-tight casing being connected to the cylinder space of the membrane cylinder. The purge gas pressure prevailing in the gas-tight casing impacts upon the piston of the membrane cylinder. The cylinder space of the membrane cylinder is sealed by the deformable membrane restrained at the cylinder shell so that on the whole a force impacts upon the membrane cylinder piston that results from the pressure difference between the pressure in the gas-tight casing and the outwardly vented cylinder space. An appropriate dimensioning of the membrane cylinder can ensure that the pressure of the purge gas is by all means sufficient to reliably actuate the valve function of the inventive gas purge device.

A particularly practicable and low-cost realization of the inventive gas purge device is obtained as a result of the fact that the internal element of the ceramic body is shorter than the external element in a way that the gas-tight enclosed volume extends into the ceramic body in the area beneath the internal element. With this variant, the deformable membrane of the gas purge device can be formed by a metal jacket surrounding the ceramic body laterally and at its bottom side. This metal jacket then also encompasses the gas-tight enclosed volume in the area beneath the shortened internal element of the ceramic body. At the bottom side of the ceramic body, the gas-tight enclosed volume with this embodiment has the shape of a narrow gap in the area between the external element of the ceramic body and the deformable membrane, so that on the whole a particularly compact construction style is obtained. Thereof, it results the benefit that the inventive gas purge device can be unproblematically implemented to substitute conventional purge plugs even in case of narrow space conditions, e.g. at the bottom side of a metallurgical melting vessel.

In accordance with another preferable embodiment of the inventive gas purge device, a thermal insulation is arranged between the ceramic body and the spring. By means of this thermal insulation, the spring is protected from the thermal load originating from the heat contained in the metallurgical melting vessel. The thermal insulation can be arranged in form of a layer of prior art insulating material either between the ceramic body and the deformable membrane and/or between the deformable membrane and the spring.

Examples of embodiments of the present invention are explained by way of drawings and figures in the following, where:

Figure 2:
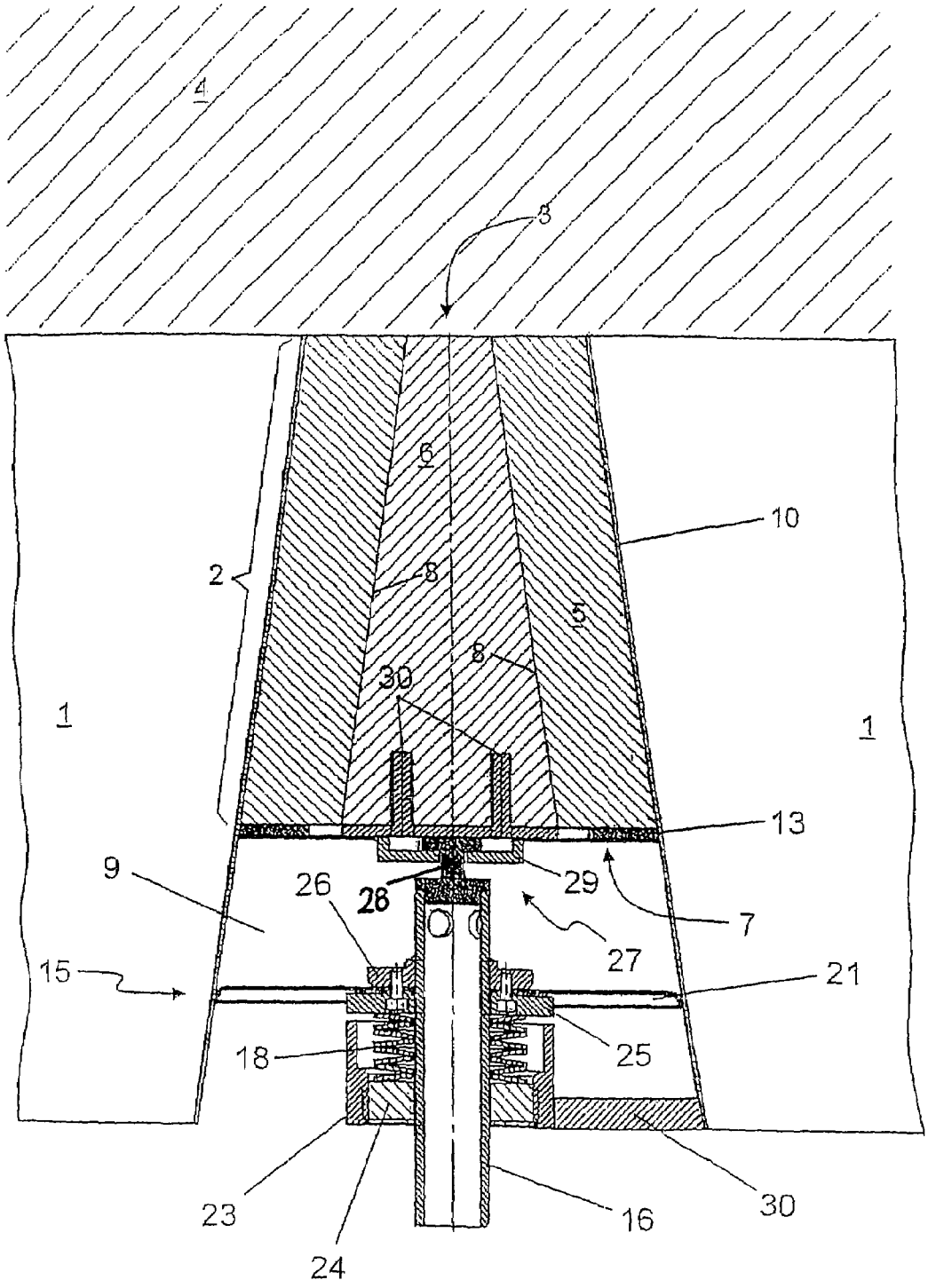
FIG. 2 shows a sectional side view of a second embodiment of the inventive gas purge device.
Figure 3A:
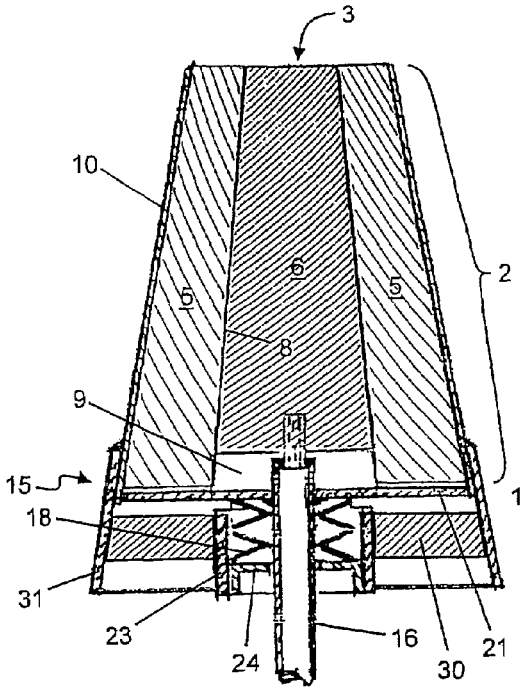
Figure 3B:
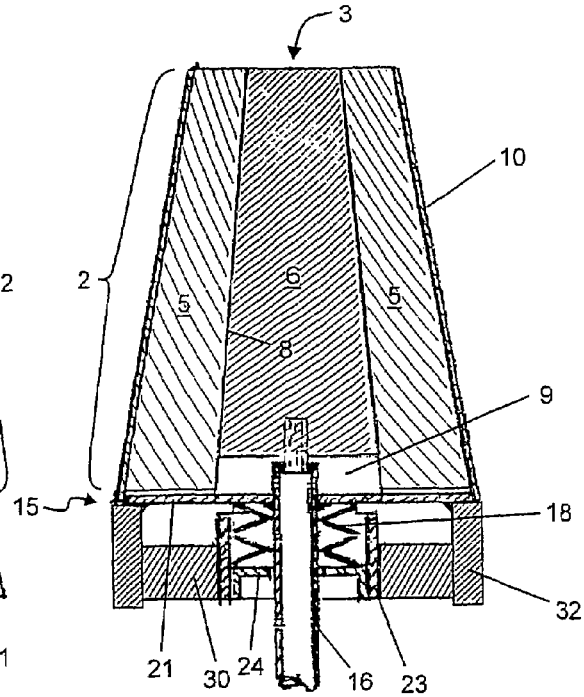
Figure 4:
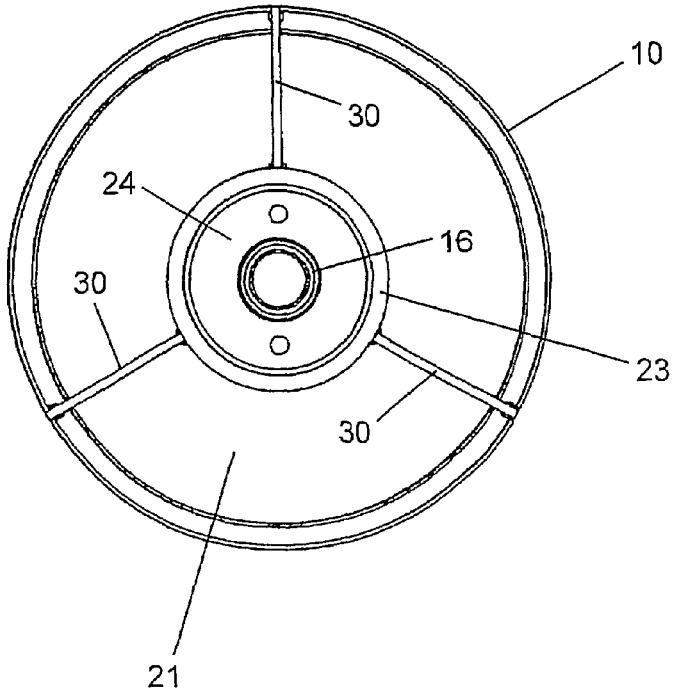

FIG. 3*a* shows a sectional side view of a third embodiment of the inventive gas purge device;

FIG. 3*b* shows a sectional side view of a fourth embodiment of the inventive gas purge device;

FIG. 4 shows a view of the bottom of the gas purge device according to FIG. 2.

Figure 1:
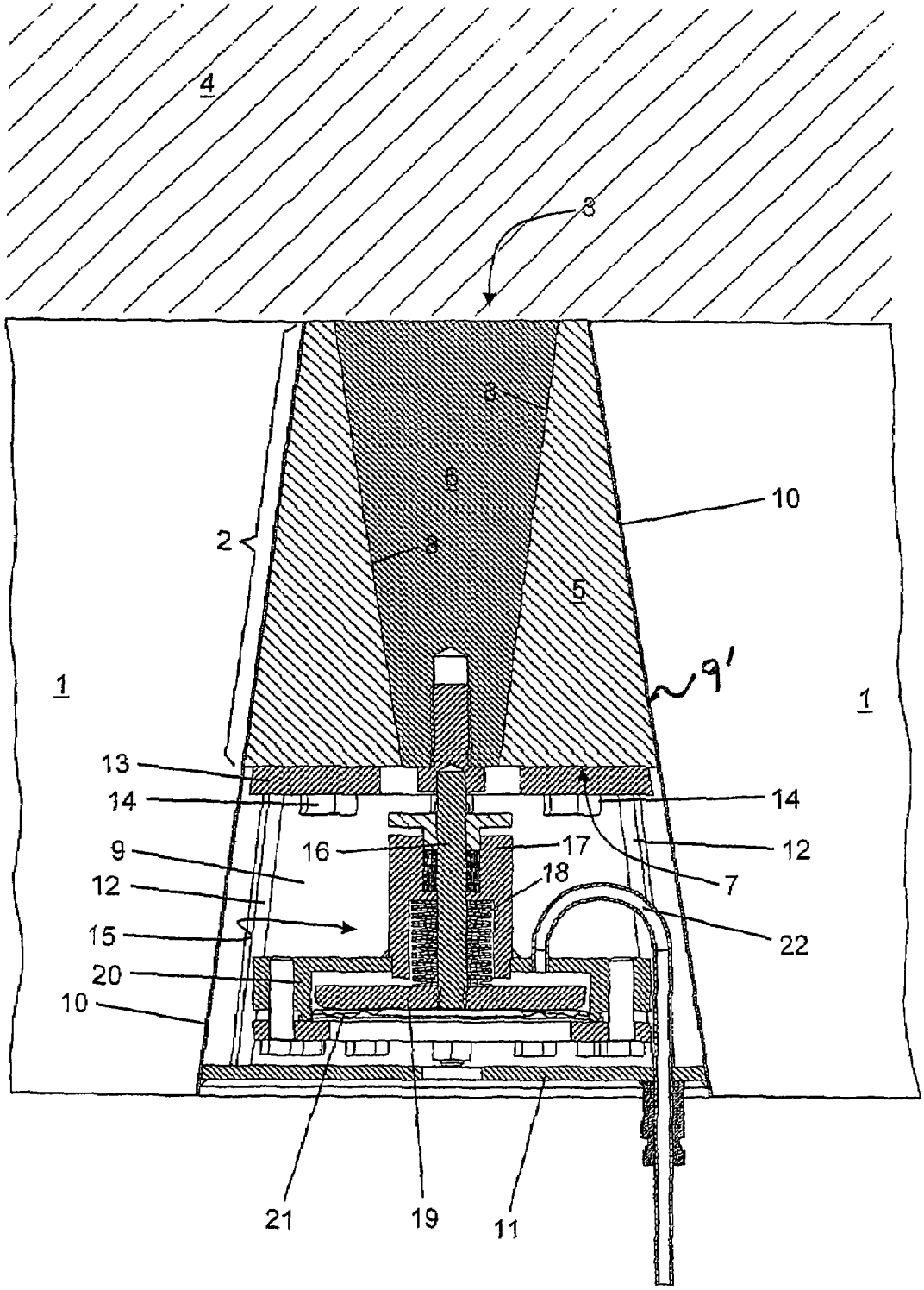
FIG. 1 shows a sectional side view of a first embodiment of the inventive gas purge device.

The gas purge devices illustrated in FIGS. 1 and 2 each are built into a metallurgical melting vessel, with these Figs. showing a clip from a bottom-side wall 1 of this vessel. The gas purge devices each comprise a conically shaped ceramic body which in its entirety is designated with reference number 2 in these Figs. the ceramic body 2 which at its top side 3 each gets in contact with a heat 4 contained in the melting vessel is comprised of a static external element and an internal element 6 that can be axially moved therein. In FIG. 1 it can be seen that the internal element 6 is tapered from the top side 3 of the ceramic body 2 towards its bottom side 7. Hence, with this embodiment, the static external element 5 forms a conical ring with an axial conical bore for the internal element 6, with the directions of taper of the static external element 5 and internal element 6 being opposite to each other. With the example of the embodiment according to FIG. 2, on the contrary, the directions of taper of the external element 5 and internal element 6 are the same. With both examples of embodiments, a continuous conically shaped annular gap 8 is formed between the internal element 6 and the external element 5 that extends each from the top side 3 of the ceramic body 2 to its bottom side 7.

The gas purge devices shown in these Figs. are in closed position in which the conical annular gap 8 is closed so that no purge gas can penetrate through the annular gap 8 into the heat 4. At the same time, no liquid metal can leak from the heat 4 through the annular gap 8 while being in closed position. To actuate the valve function with the example of the embodiment shown in FIG. 1, the internal element 6 is moved upward, i.e. towards the heat 4. With the example of the embodiment pursuant to FIG. 2, the annular gap 8 opens when the internal element 6 is moved away from the heat 4 in downward direction.

With the gas purge devices shown in these FIGS., a gas-tight volume 9 each is arranged at the bottom side of the ceramic body 2 and connected to a gas supply duct for introducing purge gas. A conical metal jacket 10 forms the side wall of the gas-tight casing 9' in a way that the conical shaping of the ceramic body 2 advances in the area of the casing 9'.

Furthermore, with the example of the embodiment shown in FIG. 1, a bottom plate 11 sealed versus the side wall 10 of the gas-tight casing 9' is provided for, with the bottom plate 11 being connected via struts 12 to a fixing plate 13 mounted to the bottom side of the ceramic body 2. With the gas purge device illustrated in FIG. 1, bolts 14 anchored in the ceramic body 2 serve as fasteners. Fastened to fixing plate 13 via distance bolts not precisely shown in FIG. 1 is a pneumatic drive 15 by way of which the internal element 6 can be axially moved to and fro relative to the external element 5 of the ceramic body 2 between the closed position and an open position.

The pneumatic drive 15 is linked through a connecting rod 16 to the axially movable internal element 6. The connecting rod 16 is movably conducted in axial direction in a stuffing box 17. Arranged in the interior of the stuffing box 17 is a spring 18 by the spring force of which the internal element 6 is retained in closed position. The spring 18 finds support at the stuffing box 17 on the one hand and at a thrust plate 19 on the other hand. The thrust plate 19 can be moved up and down in the interior of a membrane cylinder 20. The cylinder space of the membrane cylinder 20 is sealed versus the interior of the gas-tight casing 9' via a deformable membrane 21. A venting pipe 22 extending from the gas-tight casing is connected to the cylinder space of the membrane cylinder 20. Owing to the pressure difference between the purge gas pressure prevailing in the interior of the gas-tight casing 9' and the outwardly vented cylinder space, the valve function of the gas purge device illustrated in FIG. 1 is actuated.

With the example of the embodiment of the inventive gas purge device illustrated in FIG. 2, the deformable membrane 21 seals the interior of the casing 9' gas-tight in downward direction towards the environment. The connecting rod 16 with the example of this embodiment is shaped like a pipe which has holes in its upper area for introducing purge gas into the gas-tight casing 9'. Owing to the pressure difference between the purge gas pressure prevailing in the gas-tight casing 9' and the ambient pressure, the membrane 21 is deformed and bent downward. In the process, the internal element 6 linked via the connecting rod 16 to the membrane 21 is moved downward so that the annular gap 8 opens. To this effect it is required to overcome the force of the spring 18 which reliably retains the internal element 6 in closed position. The spring 18 is located in the interior of a spring housing 23 into which a pre-tensioning ring 24 for pre-tensioning the spring 18 is screwed. By way of the pre-tensioning ring 24 the pre-tension of the spring 18 can be properly adjusted to the setting required in a precise application. The spring 18 finds support in upward direction against a thrust disk 25 screwed together with the membrane 21. Through the membrane 21, the thrust disk 25 is screwed together with a retainer ring 26 which in turn is gas-tight welded to the connecting rod 16. With the example of the embodiment shown in FIG. 2, the connecting rod 16 is linked via a hinge 27 to the internal element 6 of the ceramic body 2. The hinge 27 is formed by a connecting piece 28 which is accommodated by a bearing pot 29. The bearing pot 29 is fastened from below by means of a threaded bolt 30 to the internal element 6. By means of this hinge 27 it is advantageously possible to offset any lateral misalignment as well as an angular misalignment of the connecting rod 16 relative to the internal element 6. Such a misalignment may readily occur due to possibly imprecisely controllable deformation of the membrane 21 or due to thermal expansion of the entire device. By way of the hinge 27 it is above all prevented that a misalignment, if any, causes damage to the internal element 6, which is made of brittle ceramic material, when the gas purge device is actuated.

FIGS. 3*a* and 3*b* show examples of embodiments of the inventive gas purge device which are of a configuration similar to the one of the embodiment shown in FIG. 2. The main difference constitutes in that the internal element 6 of the ceramic body 2 with the examples of embodiments shown in FIGS. 3*a* and 3*b* is shorter than the external element 5 in a way that the gas-tight enclosed volume 9 extends into the ceramic body in the area beneath the internal element 6. Hereof it results a particularly compact construction style which is best seen in FIGS. 3*a* and 3*b*. With the examples of embodiments according to FIGS. 3*a* and 3, the deformable membrane 21 is formed by the metal jacket 10 surrounding the ceramic body 2 laterally and at its bottom side 7. As shown in FIG. 3*a*, a ring-shaped retainer element in form of a conical ring 31 is welded to the metal jacket 10, said retainer element extending the metal jacket 10 downward in length. The ring 31 in turn is welded together with struts 30 which give support to the spring housing 23. The embodiment illustrated in FIG. 3*a* is destined to be built into a metallurgical melting vessel so that the device on the whole ends-up flush to the wall of the vessel. Conversely, with the example of the embodiment shown in FIG. 3*b*, a cylindrical ring 32 is welded to the metal jacket 10, said ring protruding from the bottom wall and/or side wall of the metallurgical vessel. The examples of embodiments pursuant to FIGS. 3*a* and 3*b* can be chosen depending on demand, i.e. depending on the available space in the environment of the metallurgical vessel and dependent upon the desired thickness of the ceramic body 2.

In FIG. 4, which shows the gas purge device pursuant to FIG. 2 from below, it can be seen how the spring housing 23 is supported by struts 30 welded to the wall 10.

The inventive gas purge devices are supplied with purge gas reasonably through a 3-way valve arranged in the gas supply duct and not precisely shown in the relevant FIGS. A 3-way valve of this kind ensures that the annular gap 8 closes quickly enough when the valve is shut-off. By means of the 3-way valve, the gas pressurized in the casing 9' is blown-off into the surroundings at the same time as the purge gas supply is shut-off. Then the full force of spring 18 is available for a quick closing of the annular gap 8.

With the inventive gas purge device, even more than one spring 18 may be provided to retain the internal element 6 of the ceramic body 2 in closed position. It is possible to let several springs outside the center axis of the gas purge device impact upon the membrane 21 in order to thus further increase the reliability of the gas purge device.

Furthermore, it is reasonable to provide a thermal insulation arranged between the ceramic body 2 and the spring 18. For instance, with the examples of embodiments shown in FIGS. 3*a* and 3*b*, a suitable layer of thermally insulating material can be accommodated in the narrow gap between the external element 5 of the ceramic body and the membrane 21. A thermal insulation of this kind effectively protects the spring 18 from the high thermal load originating from the heat.

The invention claimed is:

1. A gas purge device for a metallurgical melting vessel, comprising a conically shaped ceramic body getting at its top side in contact with a heat contained in the melting vessel, said ceramic body having a static external element and an internal element axially movable therein, further comprising a pneumatic drive by means of which the internal element can be axially moved to and fro relatively to the external element of the ceramic body between a closed position and an open position, with a spring being provided, by the spring force of which the internal element is retained in the closed position, and furthermore comprising a gas-tight enclosed volume arranged at the bottom side of the ceramic body, said volume being connected to a gas supply duct for introduction of purge gas, wherein the pneumatic drive comprises a deformable membrane connected through a connecting rod to the internal element, the connecting rod also connecting the internal element with the spring, with the pressure difference between the purge gas pressure prevailing in the gas-tight enclosed volume and the ambient pressure acting upon said membrane;

wherein the connecting rod is shaped like a pipe that serves as gas supply duct to introduce the purge gas into the gas-tight enclosed volume.

2. A gas purge device as defined in claim 1, wherein between said internal element and said external element a continuous conical ring gap is formed which extends from the top side of the ceramic body to its bottom side.

3. A gas purge device as defined in claim 1, wherein the gas-tight enclosed volume is formed by a casing at the bottom side of the ceramic body, with the side wall of the gas-tight casing having a conical shape, in a way that the conical shaping of the ceramic body advances in the area of the casing.

4. A gas purge device as defined in claim 3, wherein the pneumatic drive comprises a membrane cylinder, wherein a venting pipe extending from the gas-tight casing is connected to the cylinder space of the membrane cylinder.

5. A gas purge device as defined in claim 3, wherein the deformable membrane provides a gas-tight sealing for the interior of the volume in downward direction versus the environment.

6. A gas purge device as defined in claim 1, wherein the connecting rod is linked via a hinge to the internal element.

7. A gas purge device as defined in claim 1, comprising a 3-way valve arranged in the gas supply duct.

8. A gas purge device as defined in claim 1, wherein the internal element of the ceramic body is shorter than the external element in a way that the gas-tight sealed volume extends into the ceramic body in the area beneath said internal element.

9. A gas purge device as defined in claim 8, wherein the deformable membrane is formed by a metal jacket surrounding the ceramic body laterally and at its bottom side.

10. A gas purge device for a metallurgical melting vessel, comprising a conically shaped ceramic body getting at its top side in contact with a heat contained in the melting vessel, said ceramic body having a static external element and an internal element axially movable therein, further comprising a pneumatic drive by means of which the internal element can be axially moved to and fro relatively to the external element of the ceramic body between a closed position and an open position, with a spring being provided, by the spring force of which the internal element is retained in the closed position, and furthermore comprising a gas-tight enclosed volume formed by a casing at the bottom side of the ceramic body, a venting pipe extending from the casing, and a bottom plate, the casing having a side wall with a conical shape advancing in the area of the casing, the bottom plate being sealed versus the side wall and connected through struts to a fixing plate mounted to the bottom side of the ceramic body, said volume being connected to a gas supply duct for introduction of purge gas, wherein the pneumatic drive comprises a membrane cylinder having a cylinder space and a deformable membrane connected to the internal element, with the pressure difference between the purge gas pressure prevailing in the gas-tight enclosed volume and the ambient pressure acting upon said membrane, and wherein the venting pipe is connected to the cylinder space of the membrane cylinder.

11. A gas purge device for a metallurgical melting vessel, comprising a conically shaped ceramic body getting at its top side in contact with a heat contained in the melting vessel, said ceramic body having a static external element and an internal element axially movable therein, further comprising a pneumatic drive by means of which the internal element can be axially moved to and fro relatively to the external element of the ceramic body between a closed position and an open position, with a spring being provided, by the spring force of which the internal element is retained in the closed position, and furthermore comprising a thermal insulation arranged between the ceramic body and the spring and a gas-tight enclosed volume arranged at the bottom side of the ceramic body, said volume being connected to a gas supply duct for introduction of purge gas, wherein the pneumatic drive comprises a deformable membrane connected to the internal element, with the pressure difference between the purge gas pressure prevailing in the gas-tight enclosed volume and the ambient pressure acting upon said membrane.

12. A gas purge device for a metallurgical melting vessel, comprising a conically shaped ceramic body getting at its top side in contact with a heat contained in the melting vessel, said ceramic body having a static external element and an internal element axially movable therein, further comprising a pneumatic drive by means of which the internal element can be axially moved to and fro relatively to the external element of the ceramic body between a closed position and an open position, with a spring being provided, by the spring force of which the internal element is retained in the closed position, and furthermore comprising a gas-tight enclosed volume arranged at the bottom side of the ceramic body, said volume being connected to a gas supply duct for introduction of purge gas, wherein the pneumatic drive comprises a deformable membrane connected to the internal element, with the pressure difference between the purge gas pressure prevailing in the gas-tight enclosed volume and the ambient pressure acting upon said membrane, and wherein the spring is located at the bottom side of the ceramic body within a spring casing, with said spring resting at the membrane on the one hand and at a pre-tensioning ring screwable into the spring casing on the other hand, said pre-tensioning ring allowing to adjust the pretension of said spring.

13. A gas purge device as defined in claim 12, wherein said spring casing is welded through struts either to the metal jacket of the ceramic body or to a ring-shaped retainer element which in turn is linked to said metal jacket.

* * * * *

UNITED STATES PATENT AND TRADEMARK OFFICE

CERTIFICATE OF CORRECTION

PATENT NO. : 7,645,418 B2
APPLICATION NO. : 11/579706
DATED : January 12, 2010
INVENTOR(S) : Munding et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 451 days.

Signed and Sealed this

Sixteenth Day of November, 2010

David J. Kappos

David J. Kappos
*Director of the United States Patent and Trademark Office*